US007333011B2

(12) United States Patent
Singer et al.

(10) Patent No.: US 7,333,011 B2
(45) Date of Patent: Feb. 19, 2008

(54) LED-BASED LUMINAIRE UTILIZING OPTICAL FEEDBACK COLOR AND INTENSITY CONTROL SCHEME

(75) Inventors: Jeffrey M. Singer, Fairborn, OH (US); Brian J. Barnhart, New Carlisle, OH (US); Steve M. Butsch, Maumee, OH (US); Michael T. Vangeel, Pooler, GA (US); Paul L. Summers, Troy, OH (US); Scott R. Mangum, Dublin, OH (US)

(73) Assignee: Honeywell International Inc., Morristown, NJ (US)

( * ) Notice: Subject to any disclaimer, the term of this patent is extended or adjusted under 35 U.S.C. 154(b) by 98 days.

(21) Appl. No.: 11/113,539

(22) Filed: Apr. 25, 2005

(65) Prior Publication Data

US 2006/0006821 A1 Jan. 12, 2006

Related U.S. Application Data

(60) Provisional application No. 60/585,524, filed on Jul. 6, 2004.

(51) Int. Cl.
*G08B 1/08* (2006.01)

(52) U.S. Cl. ..... 340/534; 340/534; 340/310.11

(58) Field of Classification Search ..... 315/312, 315/291, 294, 307, 308, 246; 340/310.11, 340/531, 534

See application file for complete search history.

(56) References Cited

U.S. PATENT DOCUMENTS 6,292,901 B1 9/2001 Lys et al.
6,441,943 B1 8/2002 Roberts et al.
6,495,964 B1 * 12/2002 Muthu et al. ..... 315/149
6,527,422 B1 3/2003 Hutchison
6,676,279 B1 1/2004 Hubbell et al.
6,774,584 B2 8/2004 Lys et al.
6,808,287 B2 10/2004 Lebens et al.
6,909,377 B2 * 6/2005 Eberl ..... 340/815.4
7,148,632 B2 * 12/2006 Berman et al. ..... 315/189
2002/0047624 A1 4/2002 Stam et al.
2002/0140379 A1 10/2002 Chevalier et al.
2002/0191401 A1 12/2002 He
2003/0030808 A1 2/2003 Marshall et al.
2003/0193300 A1 * 10/2003 Mukherjee ..... 315/291
2003/0234342 A1 12/2003 Gaines et al.

(Continued)

FOREIGN PATENT DOCUMENTS

EP 1 176 849 A2 1/2002
EP 1 176 849 A3 1/2002

*Primary Examiner*—Trinh Dinh
*Assistant Examiner*—Dieu Hien T Duong
(74) *Attorney, Agent, or Firm*—Birch, Stewart, Kolasch & Birch, LLP

(57) ABSTRACT

A system and method for implementing an LED-based luminaire (100) incorporates one or more color channels (32-*n*). The luminaire includes a controller (50) that uses optical sensing and feedback to control LEDs (30A) in each channel to deliver a consistent intensity and/or color output. The optical feedback loop may provide measured intensity and/or color of the luminaire's output to the luminaire controller. The controller may then adjust the current, pulse width modulation (PWM) duty cycle, or both, which are delivered to discrete color channels of the luminaire to obtain the desired intensity and/or color.

19 Claims, 6 Drawing Sheets

U.S. PATENT DOCUMENTS

2004/0105261 A1 6/2004 Ducharme et al.
2004/0113044 A1 6/2004 Ishiguchi
2004/0160199 A1* 8/2004 Morgan et al. ..... 315/312
2006/0071613 A1* 4/2006 Lovato et al. ..... 315/291

* cited by examiner

LED-BASED LUMINAIRE UTILIZING OPTICAL FEEDBACK COLOR AND INTENSITY CONTROL SCHEME

CROSS-REFERENCES TO RELATED APPLICATIONS

This non-provisional application claims priority under 35 U.S.C. § 119(e) on U.S. Provisional Application No. 60/585,524 filed on Jul. 6, 2004, the entire contents of which are hereby incorporated by reference.

FIELD OF THE INVENTION

The present invention is directed to an optical feedback control system and scheme for luminaires for illumination applications based on solid state light sources.

BACKGROUND

Solid state light sources offers benefits over traditional incandescent and fluorescent lighting in some applications. The robustness, reliability and long life of light-emitting diodes (LEDs) are examples of these benefits. Currently, the intensity output of solid state light sources, such as LEDs, varies according to factors such as temperature, age, and date of manufacture. Consequently, conventional luminaires based on solid state sources do not maintain desired intensity and/or color during their lifetime.

SUMMARY OF THE INVENTION

According to exemplary embodiments of the present invention, an LED-based luminaire adjusts the current delivered to light-emitting diodes (LEDs) in the luminaire, in order to maintain a consistent color and/or intensity level. The delivered current may be adjusted based on a measured output of the LEDs, such as light intensity or color.

According to an exemplary embodiment, the luminaire includes an emitter module having one or more LEDs and a regulating device that regulates the current delivered to the emitter module. The luminaire may include an optical sensor that measures the LED radiant output, and a controller that uses the detected output to control the regulating device based on the measured output.

In another exemplary embodiment, the LED-based luminaire may incorporate one or more color channels. In such an embodiment, the optical sensor may produce an intensity output for each color corresponding to the color channels.

Exemplary embodiments of the present invention utilize the optical sensor to provide feedback to a control device that controls the operation of the regulating device. The control device causes the regulating device to deliver current in such a manner as to achieve a desired intensity and/or color from the emitter module. For instance, the control device may adjust the level, the pulse width modulation (PWM) duty cycle, or both, of the current delivered to discrete color channels of the luminaire to obtain the desired intensity and/or color output.

According to an exemplary embodiment, the controller may receive the desired intensity/color setting from an input device, or a data bus connected to an input device. Such an embodiment allows the luminaire output to be maintained at an adjustable setting.

Another exemplary embodiment is directed to a lighting system comprising a plurality of luminaires, whose control devices are connected to a common data bus.

Thus, the control scheme according to exemplary embodiments of the present invention may be used to provide consistent, uniform color/intensity, despite LED output changes caused by manufacturing variations, temperature fluctuations, and/or lumen degradation over the life of the luminaire.

DETAILED DESCRIPTION OF EXEMPLARY EMBODIMENTS

According to an exemplary embodiment, the present invention is directed to a luminaire with a light-emitting diode (LED)-based light source, which receives feedback from an optical sensor to maintain the luminaire's output at a desired level. In an exemplary embodiment, the luminaire uses this feedback to adjust the current delivered to the LED(s) in the luminaire to ensure that the output retains a desired intensity and/or color despite temperature variations and lumen depreciation of the LED(s).

Figure 1A:
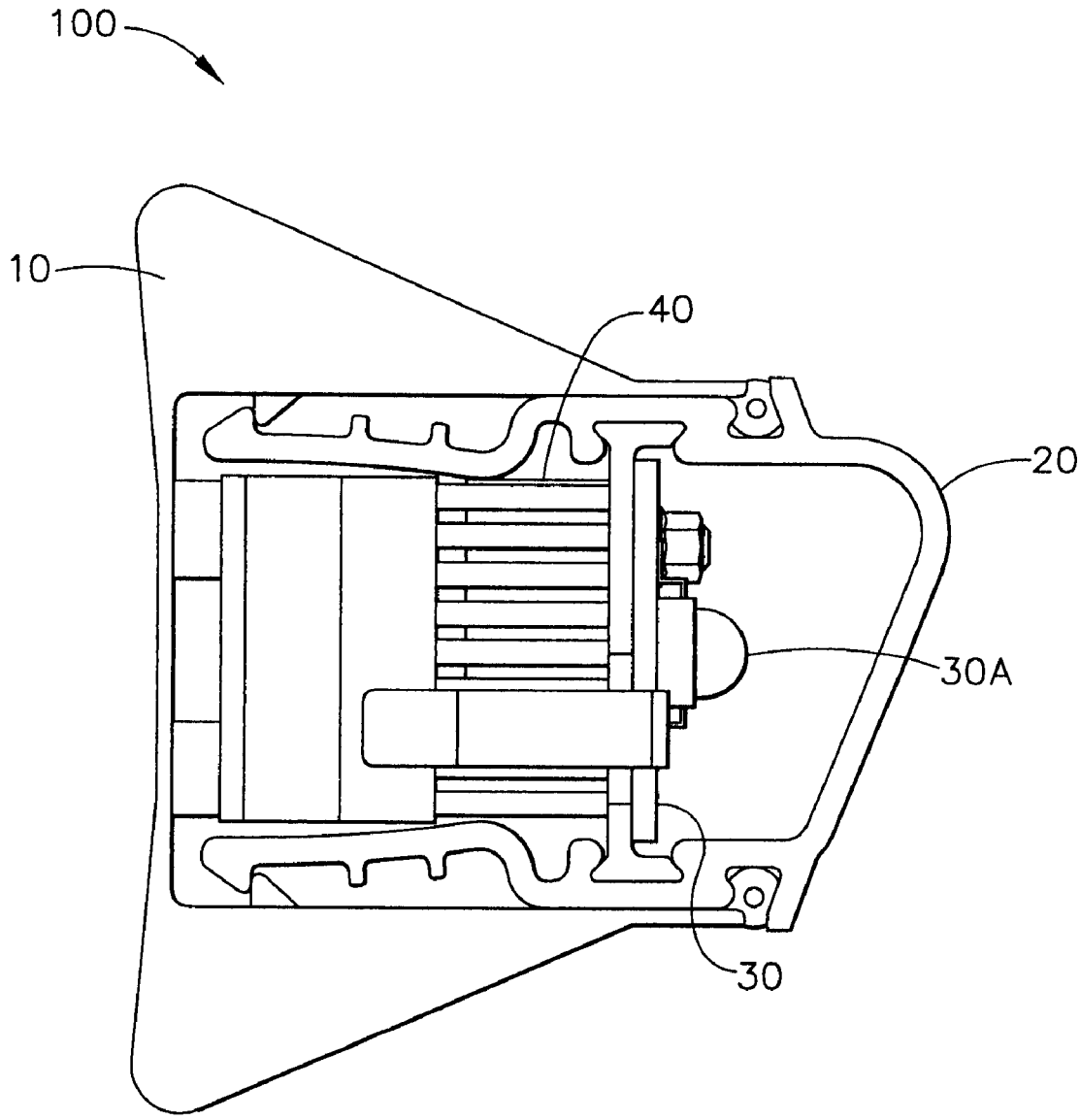
FIGS. 1A-1C illustrate various components of a luminaire, according to exemplary embodiments of the present invention.
Figure 1B:
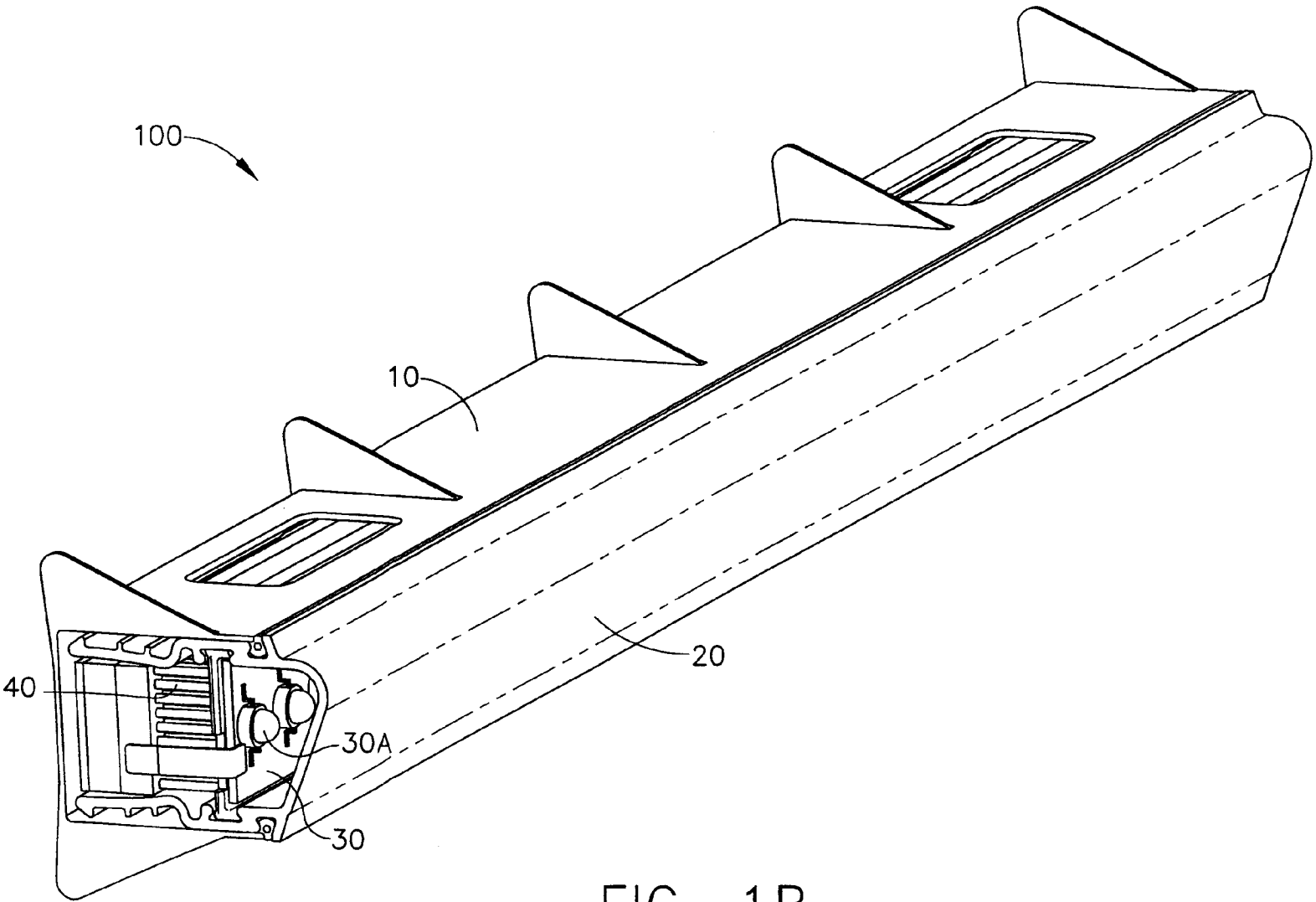
Figure 1C:
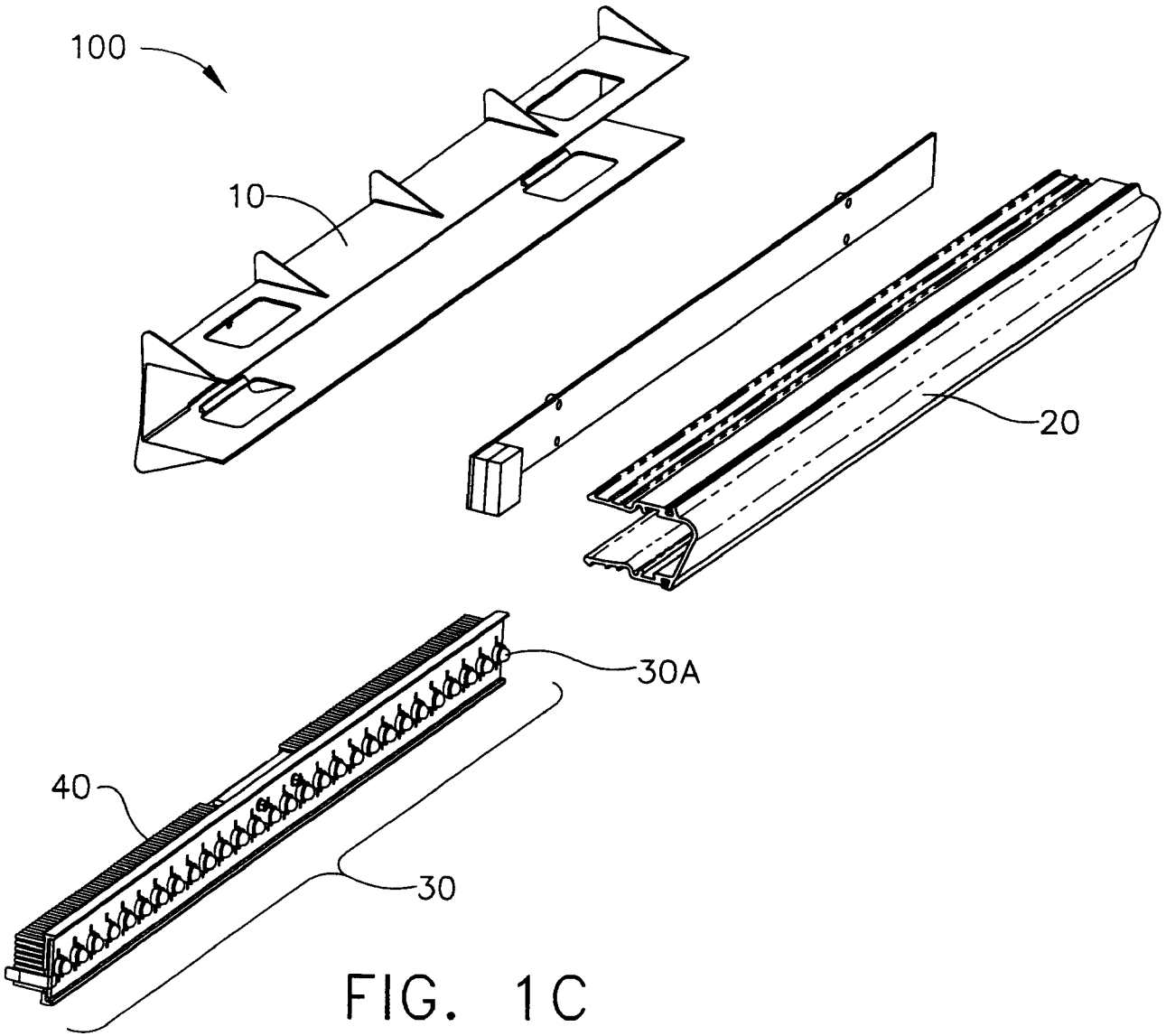

Various aspects of these components are illustrated in FIGS. 1A-1C, in accordance with an exemplary embodiment. In particular, FIG. 1A illustrates a cross-sectional view of a luminaire 100, according to an exemplary embodiment. FIG. 1B illustrates a linear portion of an assembled luminaire 100, and FIG. 1C illustrates an exploded view of various components in the luminaire 100.

Figure 2:
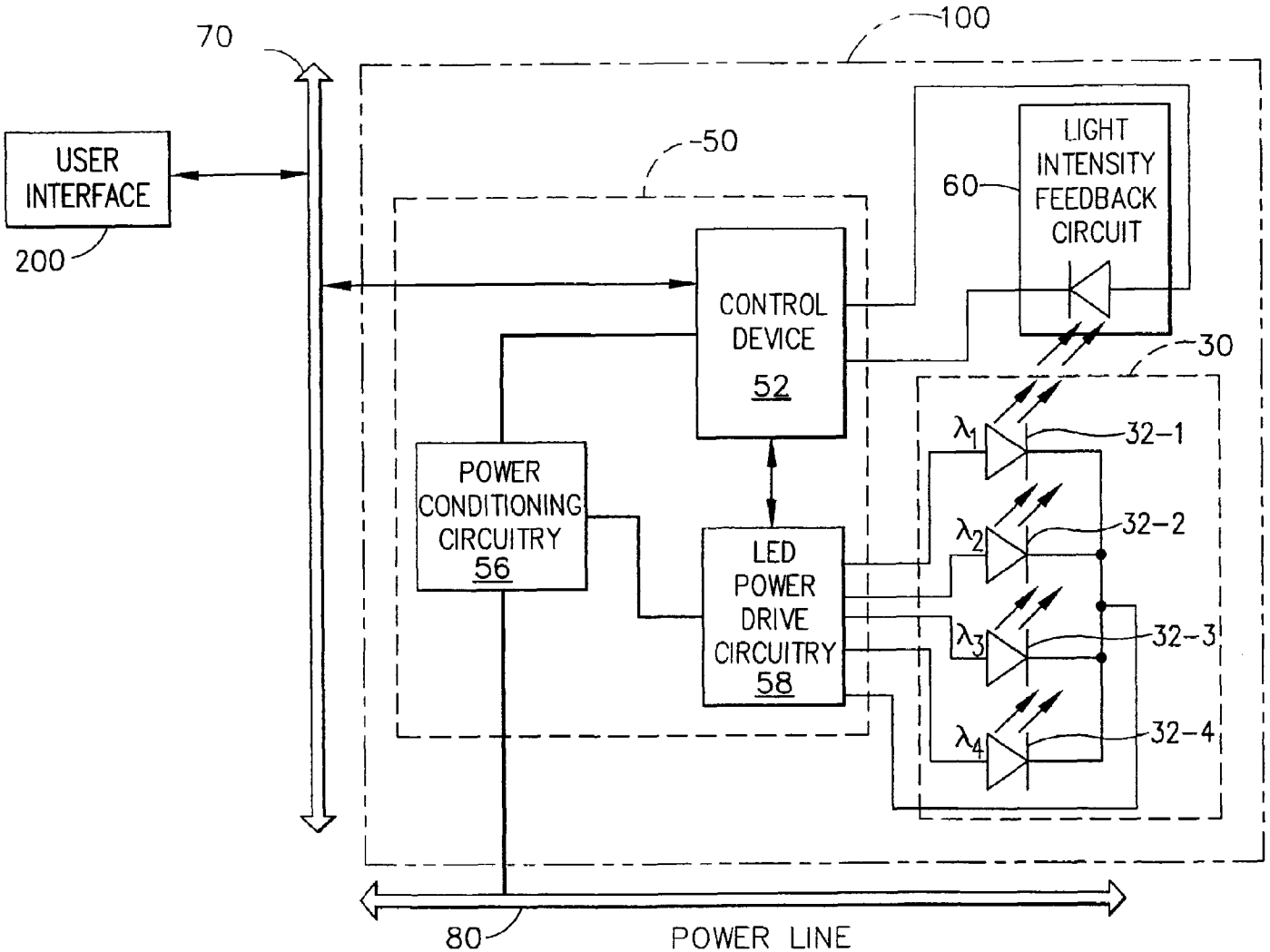
FIG. 2 is a functional block diagram of a luminaire.

As illustrated in FIGS. 1A-1C, the luminaire 100 includes a housing 10, an optical system 20, a light-emitting diode (LED)-based emitter module 30 ("LED emitter module") comprised of one ore more of LEDs 30A, and a thermal management component 40. Also, in an exemplary embodiment, the luminaire 100 includes a control module (not shown), which is connected to one or more optical sensors (not shown). The control module and optical sensor(s) are illustrated in FIG. 2 as elements 50 and 60, respectively.

It should be noted that FIGS. 1A-1C are provided for purposes of illustration only. For instance, the relative dimensions, shapes, and sizes of the components in these figures do not limit the present invention. In addition, the absence or presence of various components is also not limiting on the present invention. FIGS. 1A-1C merely illustrate one particular exemplary embodiment, e.g., where the luminaire 100 is implemented as sidewall or ceiling lights on an aircraft cabin or the like. However, those of ordinary skill in the art will realize that many variations may be made to tailor such a lighting system to other types of applications, without departing from the spirit or scope of the present invention.

According to an exemplary embodiment, the luminaire 100 may include a thermal management component 40 that is designed to dissipate heat generated in the luminaire 100. The thermal management component 40 may be comprised of passive means, such as a heat sink fastened by, or mounted to, the housing 10. Alternatively, the thermal management component 40 may be an extension of the housing 10 itself. FIGS. 1A-1C illustrate an embodiment utilizing a heat sink 40 that incorporates cooling fins. The thermal management component 40 may also include active heat-dissipating devices (not shown), such as cooling fans, thermoelectric coolers, heat pipes, or any combination thereof. In an exemplary embodiment, the thermal management component 40 is designed to maintain a safe operating temperature for the individual LEDs 30A and other electrical components in the luminaire 100.

As shown in FIGS. 1A-1C, the luminaire 100 also includes an optical component 20, according to an exemplary embodiment. The optical component 20 is designed to collect and distribute light from the LED emitter module 30 according to a desired light pattern. According to an exemplary embodiment, the optical component 20 may be comprised of a lens, reflective elements, refractive or diffusing elements, or any combination thereof. Alternatively, the optical component 20 may simply be incorporated in the packaging of the individual LEDs 30A in the LED emitter module 30.

In an exemplary embodiment, the optical component 20 may be configured to mix light from individual color channels, and the individual emitters 30A within each channel, to provide light in a desired color and pattern. For instance, the optical component 20 may utilize a combination of direct light from the LEDs 30A and reflected light to produce the desired light distribution. It should be noted that the configuration of the optical component 20 illustrated in FIGS. 1A-1C is merely illustrative and not intended to limit the invention. It will be readily apparent to those of ordinary skill in the art how to configure the optical component 20 to produce a predetermined color and/or light distribution pattern from one or more color channels.

According to an exemplary embodiment, the LED emitter module 30 includes a sufficient number of discrete LEDs 30A to provide the desired intensity and color. The LED emitter module 30 includes at least one color channel, which is comprised of one or more LEDs 30A of a particular color. In an exemplary embodiment, the individual emitters 30A in each color channel may be electrically connected either in series, in parallel, or in a combination of both series and parallel. The type of electrical connection (series, parallel, or combination) linking the LEDs 30A in each color channel may be chosen to suit the electrical supply characteristics of the luminaire 100, as will be readily contemplated by those of ordinary skill in the art.

For example, the luminaire 100 may use series-connected red, green, blue, and white LEDs 30A, to implement four corresponding color channels. However, those of ordinary skill in the art will realize that the LEDs 30A may be configured in other ways to produce the desired color channels.

FIG. 2 is a functional block diagram of a luminaire 100, according to an exemplary embodiment of the present invention. According to an exemplary embodiment, the control module 50 is configured to control the amount of current delivered to the LEDs 30A in the LED emitter module 30, based on measurements of the output of the LEDs 30A made by the optical sensor 60.

Referring to FIG. 2, the control module 50 may include control device 52, input power conditioning circuitry 56, and LED driver component 58. As shown in FIG. 2, the control module 50 may be linked to the optical sensor 60, which is located at or proximate to the LED emitter module 30 in order to measure the emitted light.

Also, FIG. 2 shows a communication line 70 that may be used by the control device 52 to receive desired intensity and/or color settings from a user interface 200. However, in an alternative embodiment, such a user interface 200 may be incorporated into the control module 50, or implemented somewhere else in the luminaire 100.

According to an exemplary embodiment, the control device 52 may be, at least partly, implemented as a digital processing device. For example, the control device 52 may comprise a microcontroller and accompanying software. However, other types of digital processing devices may also be used.

In an alternative exemplary embodiment, each of the control device's 52 functions may be performed by analog circuits and devices. In another embodiment, the control device 52 may comprise a combination of digital processing devices and analog devices as will be readily contemplated by those of ordinary skill in the art.

Referring to FIG. 2, the optical sensor 60 may be configured to measure the output of various color channels 32-1 . . . 32-N (N being the number of color channels) in the corresponding LED emitter module 30, each channel being comprised of one or more LEDs 30A of a corresponding color. For example, FIG. 2 shows the LED emitter module 30 as including four different color channels (32-1 . . . 32-4). As discussed above, the LED emitter module 30 of a luminaire 100 may include a single color channel 32-1, or multiple different-color channels 32-1 . . . 32N.

According to an exemplary embodiment, the optical sensor 60 may be a single integrated circuit (IC) device, which is capable of detecting multiple color channels 32-1 . . . 32-N. For example, one such type of multi-color optical sensor 60 is the TCS230 Light-to-Frequency Converter chip, which is manufactured by Texas Advances Optoelectronic Solutions (TAOS) of Piano, Texas. In an alternative exemplary embodiment, multiple sensor devices 60 (ICs or otherwise) may be used, each having a different spectral response corresponding to a different color. Examples of such single-color sensor devices 60 include wavelength-filtered photodiodes, which are available from various manufacturers.

In an exemplary embodiment, the power conditioning circuitry 56 is configured to provide electromagnetic interference (EMI) suppression and filtration. Also, the power conditioning circuitry 56 may be designed to convert the luminaire's 100 input power into a suitable voltage and current supply for supplying the LED driver component 58, as well as the user interface circuitry and control circuitry (which is embodied in the processing device 52, in FIG. 2). In the embodiment of FIG. 2, the input power supply is supplied by power line 80.

Figure 2A:
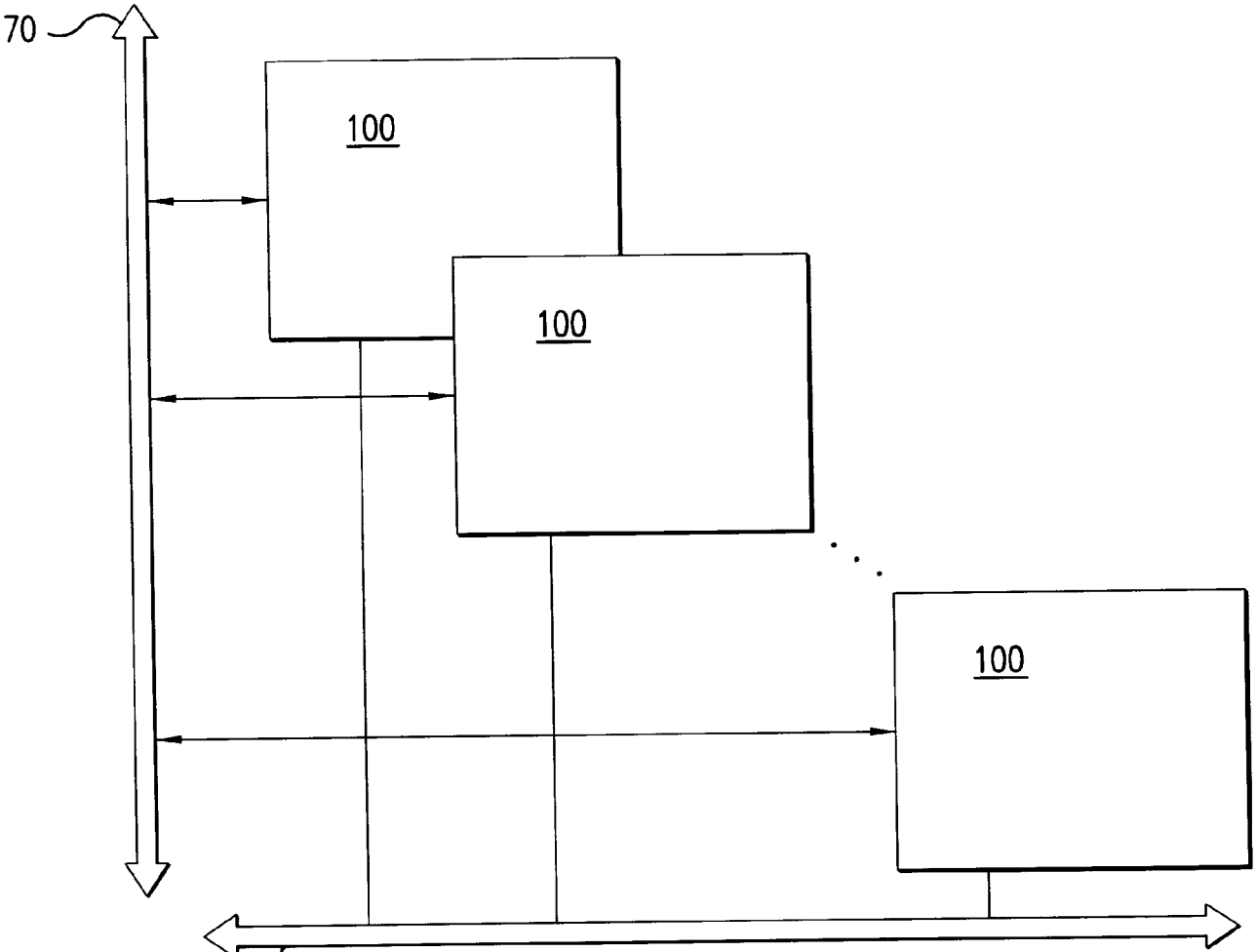
FIG. 2A is a functional block diagram of a system of luminaires, according to an exemplary embodiment of the present invention.

FIG. 2A is a functional block diagram illustrating a system of multiple luminaires 100. Such a system may be incorporated e.g., in an aircraft cabin lighting system comprising multiple ceiling and sidewall light units. In a system with multiple luminaires 100, each LED driver circuit 58 may be configured to tee off the power line 80 (e.g., as shown in FIG. 2*b*). In such an embodiment, the power line's 80 connection to the various LED driver components 58 may be implemented according to a daisy-chain, tee-and-pass configuration.

The LED driver component 58 may provide regulated current and voltage as a single supply to the LED emitter module 30 based on control signals from the control device 52. Alternatively, the LED driver component 58 may provide regulated current/voltage individually to each of the color channels 32-*n* (or groupings thereof based on the control signals. In another alternative embodiment, the LED driver component 58 may be configured to provide a regulated supply to each individual LED 30A in the LED emitter module 30.

In an exemplary embodiment, the current and voltage regulation may be accomplished using either pulse width modulation (PWM) of the current, current amplitude modulation, or a combination of both methods. The use of such methods is well known in the art. However, the LED driver component 58 may implement any other regulation method(s), which will be readily contemplated by those of ordinary skill in the art.

In an exemplary embodiment, a user interface 200 enables a user to set the intensity level for the luminaire 100 and/or the desired color output. According to an exemplary embodiment, the user interface 200 may utilize analog input circuitry, which generates a variable voltage input signal representing the selected intensity and/or color setting, and is connected to the control device 52. However, in an alternative exemplary embodiment, the user interface 200 may generate digital signals representing desired intensity and/or color settings, which are selected and input by the user.

Also, the user interface 200 may be implemented as part of the luminaire 100, or configured as a remote input device. FIG. 2 illustrates a particular embodiment where the user interface 200 is a remote device, which communicates with the control device 52 via communication line 70. When a remote user interface 200 is used, the desired intensity/color settings may be communicated to the luminaire 100 via data messages in a digital communication protocol. However, such setting may be sent in other formats.

In the embodiment illustrated in FIG. 2, the control device 52 may comprise a digital processing device that includes logic for processing messages received from a user interface. In such an embodiment, a user may input commands specifying desired settings to a remote user interface 200, which are sent to the control device 52 via communication line 70. If an analog or optical communication protocol is used, the digital processing device 52 may include interface 200 circuitry for converting messages from the user interface into digital signals.

According to an exemplary embodiment, the user may select and input settings via a remote user interface 200, which are transmitted as digital command signals via the communication line 70. For example, the communication line 70 may comprise a serial data bus or other type of digital communication line, which is used for connecting a plurality of luminaires 100 to the user interface. In such an embodiment, a serial data bus 70 (e.g., CAN, RS232 or RS485) may be implemented in a daisy-chained, tee-and-pass configuration, similar to the power line 80 shown in FIG. 2.

As used hereafter, "logic" refers to hardware (digital or analog devices), software, or any combination thereof, which is designed and implemented to perform particular functions. According to an exemplary embodiment, the control module 50 may include control logic for receiving measured signals from the optical sensor(s) 60, comparing the measured intensity and color against the desired intensity and color specified by the user (via user interface circuitry), and generating the necessary command signals to be delivered to the LED driver component 58 to maintain or obtain the desired output. The control logic may execute a specific algorithm for performing each function.

As described above, a digital processing device, such as a microcontroller, may be implemented in the control device 52 to perform many of the control functions described above, as well as to interface with the communication line 70 in order to receive and process settings from a remote user interface 200. In such an embodiment, software may be loaded into the microcontroller to implement one or more algorithms (collectively referred to as "control algorithm") for performing such functions. However, it will be readily apparent that the logic used for executing such algorithms is not limited to a microcontroller executing software.

An example of the control algorithm performed by the control device 52 will now be described. The user interface 200 may be designed to receive from the user a desired intensity and/or color setting for the luminaire 100. The user interface may further be configured to communicate the predetermined setting(s) to the control device 52 via communication line 70. Alternatively, the user interface 200 might allow the user to specify settings (intensity and/or color) separately for each color channel 32-*n* in the luminaire's 100 LED emitter module 30.

Consider the example where the user interface 200 specifies a desired intensity setting to the luminaire's 100 control device 52. This intensity setting may be directed to a particular color channel 32-*n*, or to the overall output of the luminaire 100.

In such an example, the control algorithm may cause the control device 52 to compare the received setting to a measured intensity output received from the sensor 60. For instance, the control device 52 may use the most recently received measurement from the optical sensor 60 in this comparison, wait until the next measurement is received from the optical sensor 60, or instantly command the optical sensor 60 to produce another measurement for comparison. After comparing the measured intensity to the desired setting, the control device 52 may generate a control signal based on the difference between the two. According to an exemplary embodiment, this control signal may be sent to the LED driver component 58, which regulates the delivered current based on the control signal. Particularly, the LED driver component 58 may be configured to adjust the current delivered to the LED emitter module 30 (or to a particular color channel 32-*n* therein) to substantially reduce or eliminate the difference between the measured intensity and the desired setting.

Consider another example where the user interface sends a desired color setting to the control device 52. As indicated in the earlier example, the control device 52 may compare the received color setting to the most recently received color measurement for the comparison. Alternatively, the control device 52 may wait for the next measurement from the optical sensor 60 to perform the comparison, or instantly command the optical sensor 60 to generate another measurement to be compared with the received setting.

The optical sensor 60 may be configured to measure the color output from the luminaire 100 or from an individual color channel 32-*n* therein. According to an exemplary embodiment, the optical sensor 60 may be configured to measure the color output of an individual channel 32-*n* by measuring intensities at each of a plurality of color-sensing elements (e.g., red, blue, green, and white). The optical sensor 60 may also be configured to measure an overall intensity of the emitted light. Thus, based on the ratio of measured color intensities in connection with the overall intensity, the optical sensor 60 (or, alternatively, the control device 52) may be configured to produce an overall color measurement.

By evaluating a color channel 32-*n* with each element (e.g., red, green, blue, and white) of the optical sensor 60 individually, and determining the ratios between the various readings from the elements, it is possible to differentiate between changes in intensity and shifts in wavelength of the LEDs 30A. Such differentiations might not be made through the use of a single-color sensor 60. In this embodiment, the readings from the optical sensor(s) 60 may be synchronized with the PWM cycle of the LED driver component 58 to evaluate each color channel 32-*n* during a state where only that channel 32-*n* is energized. It will be readily apparent to those of ordinary skill in the art how to design a control algorithm to distinguish between changes in intensity and wavelength based on the ratios of detected color intensities.

As described earlier, the optical sensor 60 may be comprised of a multi-color sensing device or integrated circuit capable of producing multiple color measurements. Alternatively, a plurality of individual color sensors 60 (e.g., a red, blue, green, and white sensor) may be used, each producing a single color measurement. For purposes of this description, the term "optical sensor" may refer collectively to multiple optical sensors for embodiments in which multiple sensors are used to provide measurements to the luminaire's 100 control device 52.

After comparing the measured color to the desired color setting, the control device 52 may produce a control signal based on the difference between the measured color and desired setting. This control signal may be sent to the LED driver component 58, which regulates the current sent to the luminaire 100, or individual color channel 32-*n*, in such a manner that substantially reduces or eliminates the difference.

According to an exemplary embodiment, the control algorithm of the control device 52 may be designed to receive both a desired intensity setting and color setting for the luminaire 100. In such an embodiment, the control device 52 may be configured to produce control signals for adjusting both the color and overall intensity of light emitted by the luminaire 100 or a particular color channel 32-*n* therein.

It will be readily apparent to those of ordinary skill in the art how to configure the control device 52 and LED driver component 58 to produce the desired control signals and regulate the current to adjust the intensity and/or color emitted by the luminaire 100 or a particular color channel 32-*n*. Furthermore, the present invention covers all obvious variations on the control algorithms described above. For instance, it will be readily apparent to those of ordinary skill in the art how to apply the principles of the present invention can be used to measure and adjust the intensity and/or color emitted by an individual LED 30A in the LED emitter module 30.

According to an exemplary embodiment, the control algorithm may be designed to repeatedly compare the measured output intensity/color of the LED emitter module's 30 output to the most recently received user settings. For example, such checks may be performed according to a cycle whose duration is several minutes. Thus, even when no new settings are received from a user, the control module may make adjustments to the luminaire output based on, e.g., lumen degradation and temperature variations.

The control algorithm of the control device 52 may include other functions as well. For instance, in a multi-luminaire lighting system, the control logic of each luminaire 100 may need to analyze the destination identifiers of message packets transmitted over the communication line 70. This may be required for determining whether the message packet and the user settings contained therein are intended for that luminaire 100.

According to an exemplary embodiment, each message packet transmitted over the data bus 70 may include an address segment that identifies the intended destination. Such an address segment may include a group identifier (GID). For instance, different subsets of luminaires 100 in the multi-luminaire system may be clustered together according to a particular GID. If the message packet includes settings for a particular subset of luminaires 100, the GID of that subset would be included in the address segment. Thus, the message packet would be broadcast over the data bus 70 to the designated subset of luminaires 100. Conversely, if the message packet is not intended for a particular subset of luminaires identified by a common GID, the GID field of the address segment may be set to null.

In a further exemplary embodiment, the address segment may also include fields for a type identifier (TID) and a unique identifier (UID), respectively. In such an embodiment, each luminaire 100 is assigned both a TID and UID. Multiple luminaires 100 of the same type will be assigned the same TID. However, each luminaire 100 is assigned its own UID.

In an exemplary embodiment, each transmitted message packet containing a null GID will carry a non-null TID. However, such a packet may contain a null UID. For example, if the message packet is being transmitted to each luminaire 100 corresponding to a particular type (i.e., TID), then the UID will be null. However, if the message packet is being transmitted to a singular luminaire 100, the address segment will contain that luminaire's 100 TID and UID.

Figure 3:
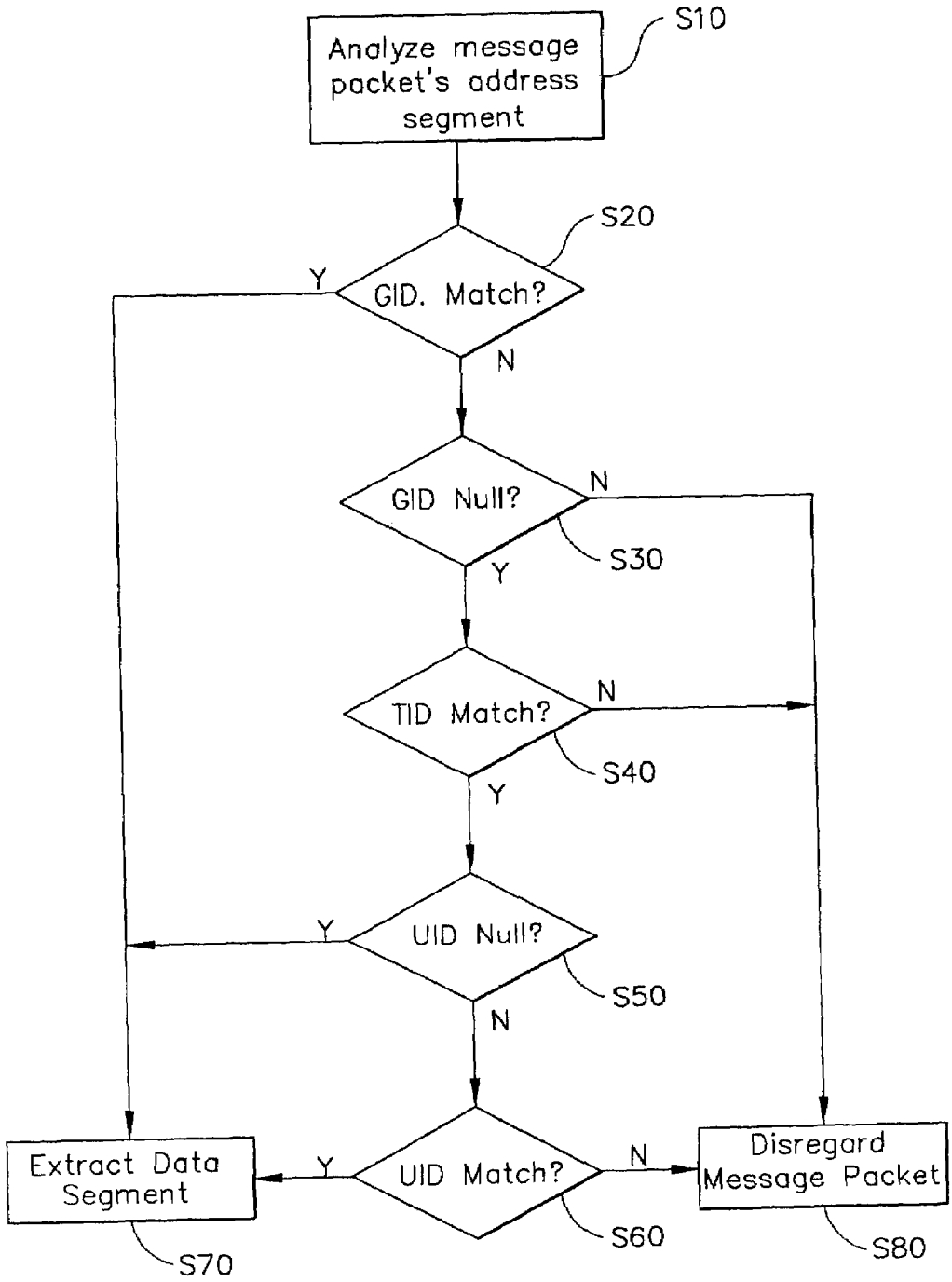
FIG. 3 is a flowchart illustrating an algorithm in a multi-luminaire system to determine whether a transmitted message contains settings for a particular luminaire, according to an exemplary embodiment.

FIG. 3 is a flowchart illustrating an algorithm by which a luminaire 100 in a multi-luminaire system determines whether a transmitted message packet contains settings for that luminaire 100. As shown in S10, the control device 52 analyzes the address segment of a transmitted message packet. The control device 52 first determines whether the address segment contains a GID that matches the luminaire's 100 GID, as shown in S20. If the GID of the message packet matches, the data (i.e., intensity/color settings) may be extracted from the packet (S70). Otherwise, processing continues to S30.

In S30, a determination is made as to whether the GID field in the packet's address segment is null. If the GID field is null, the control device 52 proceeds to analyze the TID field (S40). However, if the GID field contains a non-null value that does not match the luminaire's 100 GID, the packet can be disregarded (S80).

In S40, a determination is made as to whether the TID in the address segment matches the luminaire's 100 TID. If not, the packet can be disregarded (S80).

However, if the TIDs match, the UID of the address segment is examined according to S50. If the UID is null, the settings in the packet are destined for the luminaire 100, as well as other luminaires of the same type. Thus, the settings are extracted according to S70. However, if the UID field is non-null, processing continues to S60.

According to S60, if the UID in the packet's address segment matches the UID of the luminaire 100, this indicates that the message packet is particularly destined for the luminaire 100. Thus, the luminaire 100 extracts the settings from the packet (S70). If the packet's UID does not match the luminaire's 100 UID, then the packet is disregarded (S80).

While exemplary embodiments are described above, it should be noted that these embodiments are not limiting on the present invention. Various modifications and variations may be made to the above embodiments without departing from the spirit or scope of the present invention.

For example, while above embodiments describe a user interface 200 that allows a user to set desired intensity or color settings for the luminaire 100, the present invention is not thus limited. For instance, the settings for the luminaire may be fixed and stored within a memory or storage device within the control module 50. Alternatively, the settings may be automatically determined, e.g., by a processing system executing software. For instance, the settings may be automatically determined using factors such as time of day, ambient brightness, etc.

For purposes of illustration only, a particular exemplary embodiment of the luminaire 100 is provided in the following description.

In such an embodiment, the LED emitter module 30 of each luminaire 100 may include series-connected red, green, blue, and white LEDs 30A in four color channels. All four color channels may be sensed by a TCS230 Light-to-Frequency Converter, and controlled by software within a microcontroller-based processing device 52 of the luminaire's 100 control module 50. The software may be used for commanding a 16-bit PWM LED driver 58 in the control module 50. The elements in the control module 50, along with those in the LED emitter module 30, may be mounted to a housing 10 comprising a heat sink 12. Reflectors may be implemented in the housing, and the optical component 20 of the luminaire 100 may simply consist of optics integral to the emitter package(s), or may be comprised of a lens with any necessary geometry for directing the light to desired locations.

What is claimed is:

1. A lighting system, comprising:

a plurality of luminaires;

an input device through which a predetermined light setting is selected for each of the luminaires;

a databus communicatively linking the input device to each of the luminaires, such that the predetermined light settings are digitally transmitted via the databus to the respective luminaires, wherein each luminaire comprises:

an emitter module including a light-emitting diode (LED)-based light source, the emitter module including at least one color channel;

an optical sensor configured to periodically produce a measured output by measuring an intensity output of the emitter module; and a regulating device configured to regulate current delivered to each color channel in the emitter module based on a comparison of the periodic measured outputs of the emitter module to the respective predetermined light setting, wherein the emitter module includes a plurality of color channels, each color channel including at least one LED, and the optical sensor is configured to produce the measured output by measuring an individual intensity output for each of a plurality of colors corresponding to the color channels.

2. The system of claim 1, wherein the predetermined light setting for each luminaire includes a predetermined intensity setting, each luminaire further comprising:

a control device configured to:

compare the measured output to the predetermined intensity setting; and generate a control signal based on a difference between the measured output and the predetermined intensity setting, the control signal being sent to the regulating device to regulate the delivered current, wherein the regulating device is configured to adjust the current delivered to each color channel to reduce the difference between the intensity output and the predetermined intensity setting.

3. The system of claim 1, each luminaire further comprising a control device that determines a ratio of the individual color intensity outputs, and controls the regulating device based on the determined ratio.

4. The system of claim 3, wherein the control device is operable to distinguish between changes in color intensity and changes in wavelength corresponding to each color channel based on the determined ratio of the individual color intensity outputs.

5. The system of claim 3, wherein the predetermined light setting comprises a predetermined color setting, the control device is configured to:

determine an overall color output of the emitter module based on the determined ratio of the individual color intensity outputs;

compare the overall color output to the predetermined color setting; and generate a control signal based on a difference between the overall color output and the predetermined color setting, the control signal being sent to the regulating device to regulate the delivered current, and the regulating device is configured to adjust the current delivered to each color channel to reduce the difference between the overall color output and the predetermined color setting.

6. The system of claim 5, wherein the optical sensor is configured to produce the measured output by measuring an overall intensity output in addition to the individual color intensity outputs, and the control device is configured to:

compare the overall intensity output to a predetermined intensity setting; and generate the control signal being based on: a difference between the overall intensity output and the predetermined intensity setting, and a difference between the overall color output and the predetermined color setting, and the regulating device is configured to adjust the current delivered to each color channel to reduce a difference between the overall intensity output and the predetermined intensity setting, and reduce a difference between the overall color output and the predetermined color setting.

7. The system of claim 5, wherein the control device being communicatively linked to an input device, the input device being used to select the predetermined color setting, the optical sensor is configured to measure the individual color intensity output for each of the plurality of color channels at predetermined intervals, and for each of the predetermined intervals, the control device is configured to:

determine the overall color output based on the individual color intensity outputs of the predetermined interval, compare the overall color output to the predetermined color setting most recently received from the input device, and generate the control signal, which is sent to the regulating device, based on a difference between the most recently received color setting and the overall color output.

8. The system of claim 7, wherein the control device is communicatively linked to the input device via a data bus, and the predetermined color setting is digitally transmitted over the data bus to the control device.

9. The system of claim 5, wherein the optical sensor comprises a multi-color sensing integrated circuit.

10. The system of claim 5, wherein the optical sensor comprises one or more color sensing devices, each capable of sensing the intensity of at least one color.

11. The system of claim 5, wherein the regulating device utilizes at least one of direct current (DC) control and pulse width modulation (PWM) to regulate the current delivered to each color channel.

12. The system of claim 5, each luminaire further comprising:

a housing; and a thermal management component;

wherein the housing secures the thermal management component in a position relative to the emitter module that allows the thermal management component to dissipate heat from the emitter module.

13. The system of claim 12, wherein the thermal management component includes at least one of the following: a heat sink, a heat pipe, a cooling fan, and a thermoelectric cooling device.

14. The system of claim 12, each luminaire further comprising:

an optical component configured to collect and distribute light from the emitter module according to a predetermined pattern.

15. The system of claim 1, wherein, for each luminaire, the emitter module includes a plurality of color channels, each color channel including an equal number of LEDs, and the optical sensor is configured to produce the measured output by measuring an intensity for each of a plurality of colors corresponding to the plurality of color channels.

16. The system of claim 1, wherein, for each of the luminaires, the luminaire includes a control device configured to:

analyze an address segment in a message packet transmitted on the data bus to determine whether the message packet is pertinent to the luminaire;

if the message packet is pertinent, extract the selected predetermined light setting from a data segment in the message packet; and generate the control signal sent to the regulating device based on the extracted predetermined light setting.

17. An aircraft cabin luminaire comprising:

a light-emitting device including a plurality of color channels, each color channel including at least one light source;

an optical sensor configured to produce a measured output by measuring an intensity output for each of a plurality of colors corresponding to the plurality of color channels of the light-emitting device;

a regulating device configured to regulate current delivered to each color channel in the light-emitting device based on a comparison of the measured output of the light-emitting device to a selectable predetermined light setting; and a housing configured to secure the light-emitting device, optical sensor, and regulating device to a ceiling or sidewall of an aircraft cabin.

18. An aircraft cabin lighting system including a plurality of luminaires as claimed in claim 17, the plurality of luminaires being configured to daisy-chain power from the aircraft power line, the system comprising:

an input device through which the predetermined light setting is selected for each luminaire; and a data bus for digitally transmitting the predetermined light setting to each luminaire.

19. A lighting system, comprising:

a plurality of luminaires;

an input device through which a predetermined light setting is selected for each of the luminaires;

a databus communicatively linking the input device to each of the luminaires, such that the predetermined light settings are digitally transmitted via the databus to the respective luminaires, wherein each luminaire comprises:

a light-emitting device including at least one color channel;

an optical sensor configured to periodically produce a measured output by measuring an intensity output of the light-emitting device; and a regulating device configured to regulate current delivered to each color channel in the light-emitting device based on a comparison of the periodic measured outputs of the light-emitting device to the respective predetermined light setting, wherein, each of the luminaires includes a control device configured to:

analyze an address segment in a message packet transmitted on the data bus to determine whether the message packet is pertinent to the luminaire;

if the message packet is pertinent, extract the selected predetermined light setting from a data segment in the message packet; and generate the control signal sent to the regulating device based on the extracted predetermined light setting.

* * * * *